US005148676A

United States Patent [19]

Moriya et al.

[11] Patent Number: 5,148,676

[45] Date of Patent: Sep. 22, 1992

[54] CONFLUENCE VALVE CIRCUIT OF A HYDRAULIC EXCAVATOR

[75] Inventors: Yukio Moriya, Kanagawa; Toshio Yokoyama, Uji; Fujitoshi Takamura, Hirakata; Takumi Onoda, Kawasaki, all of Japan

[73] Assignee: Kabushiki Kaisha Komatsu Seisakusho, Tokyo, Japan

[21] Appl. No.: 555,494

[22] PCT Filed: Nov. 29, 1989

[86] PCT No.: PCT/JP89/01201

§ 371 Date: Oct. 10, 1990

§ 102(e) Date: Oct. 10, 1990

[87] PCT Pub. No.: WO90/07031

PCT Pub. Date: Jun. 28, 1990

[30] Foreign Application Priority Data

Dec. 19, 1988 [JP] Japan ..... 63-321784

[51] Int. Cl.[5] ..... E02F 3/43; F16D 31/02; F15B 13/04

[52] U.S. Cl. ..... 60/429; 60/430; 60/422; 60/486; 91/28; 91/532

[58] Field of Search ..... 60/429, 430, 433, 486, 60/494, 422; 91/28, 522, 531, 532, 29, 31; 417/216, 428

[56] References Cited

U.S. PATENT DOCUMENTS

| | | | |
|---|---|---|---|
| 2,643,516 | 6/1953 | Carlson | 91/28 X |
| 4,062,269 | 12/1977 | Chichester et al. | 91/459 X |
| 4,073,141 | 2/1978 | Lohbauer | 60/486 X |
| 4,171,054 | 10/1979 | Tanaka et al. | 60/477 X |
| 4,201,052 | 5/1980 | Breeden et al. | 91/461 X |
| 4,424,673 | 1/1984 | Polanski et al. | 60/486 |
| 4,473,090 | 9/1984 | Uehara et al. | 91/28 X |
| 4,475,442 | 10/1984 | Breeden | 91/461 |
| 4,516,467 | 5/1985 | Keeney et al. | 60/486 X |
| 4,537,029 | 8/1985 | Gunda et al. | 60/429 X |
| 4,558,629 | 12/1985 | Unger et al. | 91/531 X |
| 4,635,439 | 1/1987 | Wible | 60/486 X |
| 4,759,183 | 7/1988 | Kreth et al. | 60/422 |
| 4,779,416 | 10/1988 | Chatterjea et al. | 60/429 |
| 4,788,820 | 12/1988 | Sakai et al. | 60/486 X |
| 4,986,072 | 1/1991 | Kubomoto | 60/430 X |

FOREIGN PATENT DOCUMENTS

| | | | |
|---|---|---|---|
| 59-86704 | 5/1984 | Japan . | |
| 59-173762 | 11/1984 | Japan . | |
| 61-2568 | 1/1986 | Japan . | |
| 0818806 | 4/1981 | U.S.S.R. | 91/531 |

*Primary Examiner*—Edward K. Look
*Assistant Examiner*—John Ryznic
*Attorney, Agent, or Firm*—Richards, Medlock & Andrews

[57] ABSTRACT

A service valve circuit of a hydraulic excavator connected beforehand for use in controlling a special attachment in addition to a prescribed actuator control valve. The service valve circuit comprises a confluence valve 17 for performing electromagnetic proportional flow rate control, disposed in a confluence circuit 16 in communication with the section between inflow circuits 3F and 3R of two variable pumps 2F and 2R, an electrical switch 21 for switching the confluence valve 17 on or off according to a required flow rate and a volume 22 for adjusting the quantity of flow after passing through a confluence valve 17 in a range of flow for a maximum of one to two pumps. Since the requirement of confluence with respect to a required quantity of flow for a special attachment e and the quantity of confluence are set in advance, there will be no excess or shortage of the quantity of confluence. Therefore, the adjustment of flow rate using the number of rotations of an engine is not required and the action will not be slowed down even if switched from a special attachment control to a pivoting or traveling control.

12 Claims, 3 Drawing Sheets

CONFLUENCE VALVE CIRCUIT OF A HYDRAULIC EXCAVATOR

FIELD OF THE INVENTION

The present invention relates to a service valve circuit of a hydraulic excavator and, in particular, to a service valve circuit of a hydraulic excavator which has been connected beforehand for use in controlling a special attachment in addition to a prescribed actuator control valve.

DESCRIPTION OF THE RELATED ART

As shown in FIG. 3, a hydraulic excavator is generally equipped with a pivoting motor a in the upper chassis which is actuated by one or more units of variable capacity type hydraulic pumps (hereinafter referred to as a variable pump) driven by means of an engine, a boom cylinder b, an arm cylinder c and a bucket cylinder d for the control of a work machine, a hydraulic breaker e as a special attachment in place of the bucket, and a traveling motor f in the under traveling car. Most of the basic circuits of such a hydraulic excavator are as shown in FIG. 4. The following apparatuses are connected to two units of the variable pumps 2F and 2R driven by an engine 1 according to power distribution. That is, a left traveling control valve 4, a boom control valve 5, a bucket control valve 6, and a service valve 8F for controlling the hydraulic breaker e employed as a special attachment are connected to the inflow circuit 3F of the one variable pump 2F. To the inflow circuit 3R of the other variable pump 2R are connected a right traveling control valve 9, an arm control valve 10, a pivoting control valve 11, and a service valve 8R for controlling a special attachment.

There often arises a case in which a required quantity of flow in an actuator connected to the inflow circuit 3F of the variable pump 2F, for example, the boom cylinder b, must be backed up from the other variable pump 2R. As a confluence circuit in such a case, a control valve for confluence is required and this control valve is needed not only for the boom cylinder b but for each actuator. In the case of the service valves 8F and 8R, particularly, a great variety of special attachments can be installed. Therefore, the required quantity of flow differs in each case, and the confluence circuit needs to be so arranged that it can be used for the range from a small flow rate to a large flow rate. Hence, the service valves 8F and 8R should be connected to the inflow circuit 3F and 3R of both the variable pumps 2F and 2R. For example, where the hydraulic breaker e is installed in the service valve 8F of the inflow circuit 3F and a required quantity of flow must be backed up from the other variable pump 2R, a control valve 12 for confluence must be disposed beforehand as its confluence circuit.

In such service valve circuits, the service valves 8F and 8R, the frequency of whose use is relatively low, must be connected to the inflow circuits 3F and 3R of both the variable pumps. In addition, the service valve circuit is uneconomical and complex owing to the fact that the control valve 12 for confluence must be disposed beforehand according to a required quantity of flow. The control valve 12 for confluence performs only on-off control with an opening and closing valve and control of the confluent flow rate cannot be exercised. Therefore, the flow rate is adjusted using the number of rotations of an engine. This method of control causes inconveniences such that when it is switched from a special attachment control to a pivoting or traveling control, the action is slowed down.

SUMMARY OF THE INVENTION

The present invention has been devised in light of the above-mentioned circumstances. Accordingly, it is an object of the present invention to provide a service valve circuit of a hydraulic excavator, in which an excessive quantity of confluence is not needed, by setting in advance the requirement of confluence with respect to a required quantity of flow for a special attachment and the quantity of confluence, and which will not be slowed down even if switched from a special attachment control to a pivoting or traveling control without adjusting the quantity of flow using the number of rotations of an engine.

According to the present invention, there is provided a service valve circuit of a hydraulic excavator in which a confluence valve for performing electromagnetic proportional flow rate control is disposed in a confluence circuit in communication with the section between two units of variable pumps, an electrical switch for switching the confluence valve on or off according to a required quantity of flow, and a volume signal for adjusting flow rate after passing through a confluence valve in a range for a maximum of one to two pumps. When it is determined from the required quantity of flow for an installed special that confluence is needed, the electrical switch is turned on and the maximum quantity of flow after passing through the confluence valve is set using the volume signal. Then a service valve control lever is moved from the normal state "N" to an operating state. The confluence valve is not open until the discharge flow rate of the variable pump at the side on which the service valve is connected reached the full capacity of that pump. When the discharge flow rate becomes full and the control lever is moved further, the bleed off valve at the confluence side is closed and the confluence valve opens so that the required flow quantity from the first pump and the required flow quantity from the second pump flow together.

With the above-mentioned construction, even if maximum quantities of flow of various kinds of special attachments differ, excessive confluence will not be made Therefore, the quantity of flow need not be adjusted using the number of rotations of an engine, and even if switched from a special attachment control to a pivoting or traveling control, the action will not be slowed down.

These and other objects, features and advantages of the present invention will become clear when reference is made to the following description of the preferred embodiments of the present invention, together with reference to the accompanying drawings.

DETAILED DESCRIPTION OF THE PREFERRED EMBODIMENTS

Figure 1:
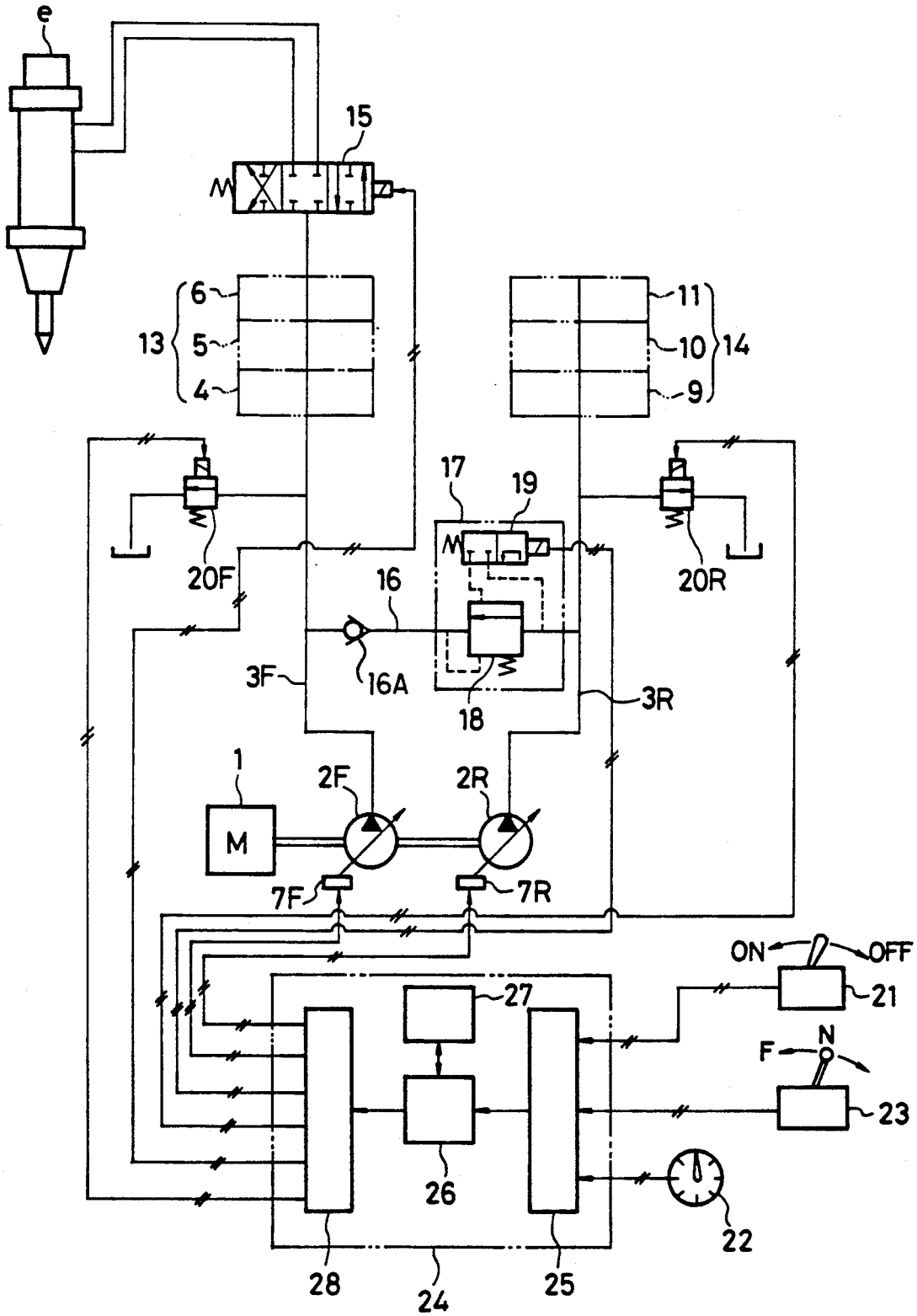
FIG. 1 is a service valve circuit diagram showing a first embodiment of the present invention.

FIG. 1 is a service valve circuit diagram showing one embodiment of the present invention. Two units of variable pumps 2F and 2R are driven by a common engine 1. The control of the discharge rate of these pumps is performed by regulators 7F and 7R. A control valve group 13 consisting of a left traveling control valve 4, a boom control valve 5, and a bucket control valve 6 is connected to the inflow circuit 3F of the one variable pump 2F A control valve group 14 consisting of a right traveling control valve 9, an arm control valve 10, and a pivoting control valve 11 is connected to the inflow circuit 3R of the other variable pump 2R. A service valve 15 for controlling a special attachment is connected to the inflow circuit 3F of the one variable pump 2F. As this special attachment, a hydraulic breaker e, employed as a rock crushing work machine is installed in this embodiment. To ensure a required flow rate for the hydraulic breaker e, a confluence circuit 16 for backing up a discharge flow rate from the other variable pump 2R is disposed between the inflow circuits 3F and 3R of the variable pumps 2F and 2R. A confluence valve 17, consisting of a piloting valve 19 and a proportional flow rate control poppet valve 18, is disposed in the confluence circuit 16 between inflow circuits 3R' and 3F. A first flow port of poppet valve 18 is connected to inflow circuit 3R, while a second flow port of poppet valve 18 is connected through check valve 16A to inflow circuit 3F. The poppet valve 18 and check valve 16A provide one-way fluid communication from inflow circuit 3R to inflow circuit 3F, with the check valve 16A being located downstream of the poppet valve 18. The piloting valve 19 provides for fluid communication between the upstream side of poppet valve 18 and one control side of poppet valve 18, while the other control side of poppet valve 18 is connected to the confluence conduit between the downstream side of poppet valve 18 and the check valve 16A. The confluence valve 17 is adapted to make the poppet valve 18 open at a valve opening corresponding to the operation of the pilot valve 19 by an electrical signal from a controller 24 to be described later. Bleed off valves 20F and 20R for regulating operating speed are disposed in the section downstream of the confluence valve 17 and upstream of the respective one of control valves 13 and 14.

Next, the control of the service valve 15 in a circuit constructed as shown above will be explained. The control is completely electronic. First, whether or not confluence should be made is checked from a required flow rate of the hydraulic breaker e. When it is sufficient merely from the flow rate from the variable pump 2F at the side on which the service valve 15 is connected, namely, when confluence is not needed, a confluence switching electrical switch 21 is left unchanged in the state of "off". In contrast to this, when confluence is needed, the confluence switching electrical switch 21 is switched to "on" and the confluence flow rate is set by using a volume 22 for regulating confluence flow rate. Next, when a service valve control lever 23 is moved from the normal state "N" to a required direction, the port of the service valve 15 is switched and pressure oil is supplied to the hydraulic breaker e, causing this breaker to operate. This pressure oil is first supplied from the variable pump 2F at the service valve side, and the confluence valve 17 is left closed until the discharge flow rate of pump 2F reaches its full capacity. When the control lever 23 is further moved after the discharge flow rate of pump 2F has reached its full capacity, the confluence valve 17 gradually opens. As the discharge flow rate from the variable pump 2R at the confluence side increases, a bleed off valve 20R is closed and a portion of the discharge flow from pump 2R through the confluence circuit 16 joins together with the flow from pump 2F in the inflow circuit 3F at the service valve side. In this way, since the valve opening of the confluence valve 17 is proportional to the control amount of the service valve control lever 23, the confluence flow rate can be controlled freely. Therefore, the striking capability of the hydraulic breaker e can be used properly depending upon a hard rock or a soft rock. A second service valve may be connected to the service valve 15 so that another special attachment may be used too. In that case, it is easy to install an additional second service valve control lever.

The control of the service valve confluence flow rate in this embodiment is performed under electronic control, as shown in FIG. 1. An electrical signal circuit is formed in such a way that when input signals for the confluence switching electrical switch 21, the service valve control lever 23, and the volume signal 22 are input to an input interface 25 in the controller 24, these signals pass through an output interface 28 for outputting values obtained from a calculation and control via a control circuit 26 for performing a required calculation and control and a storage circuit 27 for storing a processing procedure, constants and so forth on the basis of the signals, and output signals are output to the confluence valve 17, the service valve 15, the regulators 7F and 7R of both the variable pumps, and the bleed off valves 20F and 20R, respectively.

Figure 2:
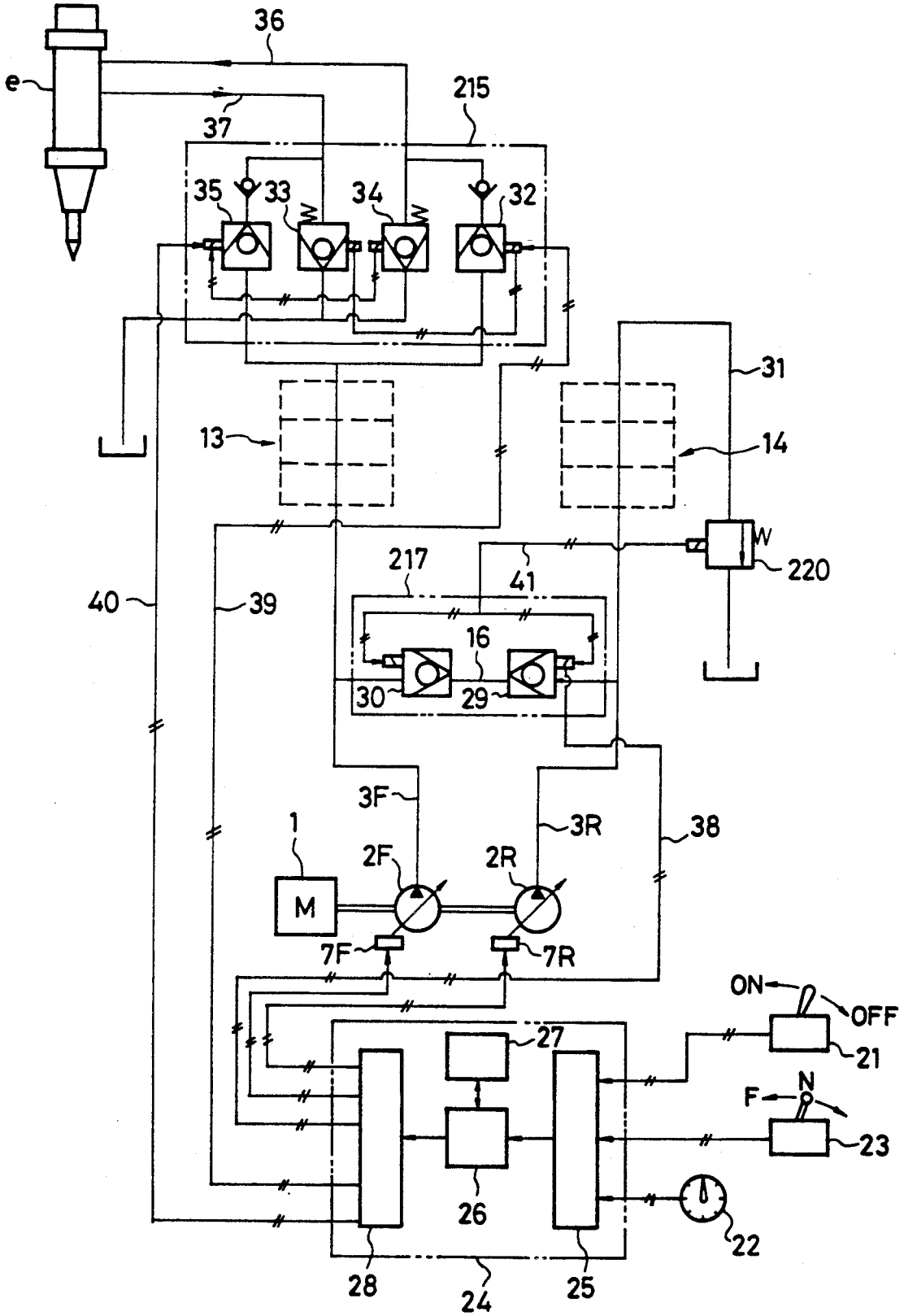
FIG. 2 is a service valve circuit diagram showing a second embodiment of the present invention.
Figure 3:
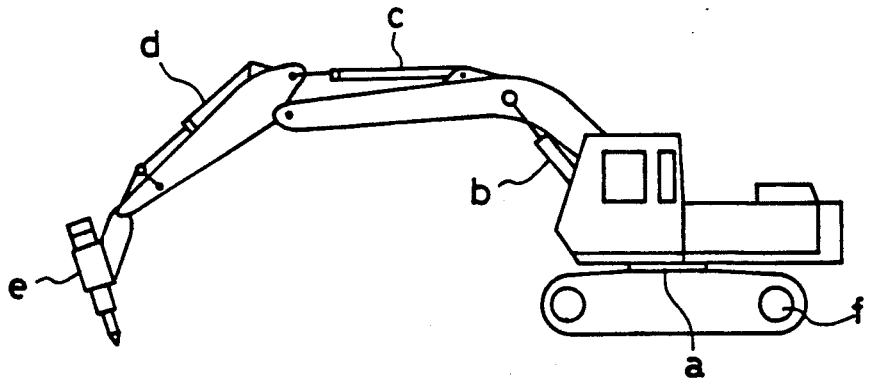
FIG. 3 (PRIOR ART)
FIG. 3 is a schematic side view in which a hydraulic breaker is installed in place of the bucket of a hydraulic excavator.
Figure 4:
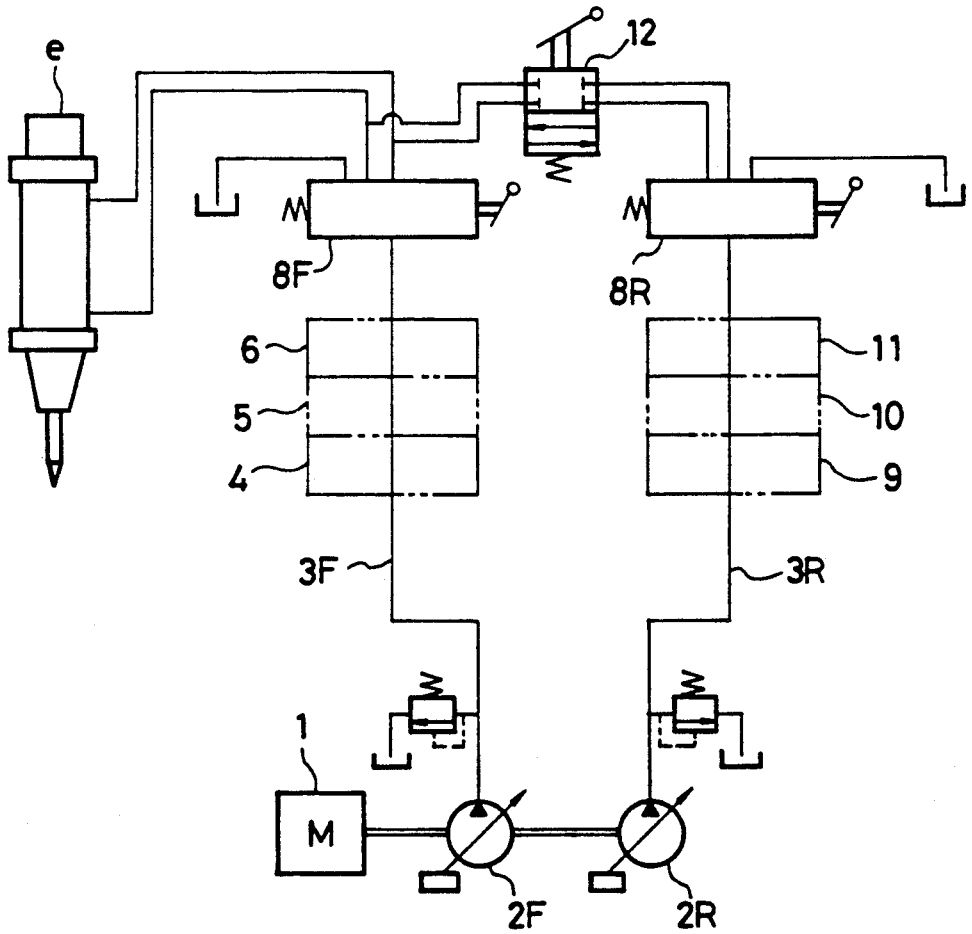
FIG. 4 (PRIOR ART)
FIG. 4 shows one example of a conventional service Valve circuit diagram.

FIG. 2 is a service valve circuit diagram showing a second embodiment of the present invention. The same reference numerals are given to the same construction as that in FIG. 1 and the explanation thereof is omitted. In the second embodiment, electromagnetic proportional flow rate control is performed by using a meter-in valve and a meter-out valve as a confluence valve 217, and also a meter-in valve and a meter-out valve as a service valve 215. First, the confluence valve 217 will be described. A meter-in valve 29 and a meter-out valve 30 are disposed in the confluence circuit 16 in communication with the section between the inflow circuits 3F and 3R of both the variable pumps. An electrical signal circuit is formed in such a way that these valves are electronically controlled by an output signal 38 from the controller 24 and at the same time this signal 38 is output as signal 41 to a bleed off valve 220 disposed in the drain circuit 31 at the confluence side. Meter-in valves 32 and 33 and meter-out valves 34 and 35 are disposed as the service valve 215 in the inflow circuit 3F of the variable pump 2F at the service valve side. An electrical signal circuit is formed in such a way that each of these valves is electronically controlled by an output signal from the controller 24.

The service valve 215 in the above-mentioned circuit is controlled as follows. When confluence should be made from a required flow rate of the hydraulic breaker e, the confluence switching electrical switch 21 is switched to "on"; a confluence flow rate is set using the volume signal 22; and the service valve control lever 23 is turned from the normal state "N" to a required direction. For example, as shown in FIG. 2, where pressure oil is supplied to an oil path 36 of the hydraulic breaker e and is drained from an oil path 37, when the control lever 23 is turned in the F direction shown in FIG. 2, a control signal is sent to the meter-in valve 29 and the meter-out valve 30 of the confluence valve 217 from the controller 24 via an electrical signal circuit 38 and both valves open gradually. At the same time, the control signal is also sent to the bleed off valve 220 via the electrical signal circuit 41 and this valve is closed. As a result, a flow rate determined from a valve opening proportional to the control amount of the service valve control lever 23 flows together to the inflow circuit 3F of the variable pump 2F at the service valve side.

Also, a control signal in response to the control amount of the service valve control lever 23 is sent to the meter-in valves 32 and 33, and the meter-out valves 34 and 35 of the service valve 215 via the electrical signal circuits 39 and 40, respectively and each valve opens. As a result, oil at a flow rate determined from the valve opening proportional to the control amount of the service valve control lever 23 is supplied to the oil path 36 of the hydraulic breaker e and is drained from the oil path 37. When this control lever 25 is completely turned, a required flow is supplied by pumps 2F and 2R together and the hydraulic breaker e operates fully by the required flow rate.

The service valve circuit of the present invention is suitable for use in a service valve circuit of a hydraulic excavator which is connected beforehand for use in controlling a special attachment such as a hydraulic breaker or the like in addition to a prescribed actuator control valve.

Many widely different embodiments of the present invention can be made without departing from the spirit and scope thereof, therefore it is to be understood that this invention is not limited to the specific embodiments thereof except as defined in the appended claims.

We claim:

1. Apparatus comprising a first variable capacity type hydraulic pump having an output, a second variable capacity type hydraulic pump having an output, a first group of control valves with each of the control valves in said first group being connected to a respective one of a first plurality of hydraulic actuators, a second group of control valves with each of the control valves in said second group being connected to a respective one of a second plurality of hydraulic actuators, a first hydraulic supply line connected between the outlet of said first variable capacity type hydraulic pump and said first group of control valves to supply hydraulic fluid to the first plurality of hydraulic actuators connected to the first group of control valves, a second hydraulic supply line connected between the outlet of said second variable capacity type hydraulic pump and said second group of control valves to supply hydraulic fluid to the second plurality of hydraulic actuators connected to the second group of control valves, and a confluence circuit connected to said first hydraulic supply line and to said second hydraulic supply line, said confluence circuit having an electromagnetically actuated confluence valve positioned therein for performing proportional flow rate control in the confluence circuit when confluence is desired;

wherein said confluence valve comprises an electromagnetically actuated piloting valve and a proportional flow rate control valve; said proportional flow rate control valve having first and second control inputs and first and second flow ports, said first flow port of said proportional flow control valve being connected to said first hydraulic supply line, said second flow port of said proportional flow control valve being connected to said second hydraulic supply line; said piloting valve having a first position, in which it provides fluid communication between said first hydraulic supply line and said first control input of said proportional flow control valve, and a second position in which the fluid communication between said first hydraulic supply line and said first control input of said proportional flow control valve is interrupted; said second control input of said proportional flow control valve being connected to said second flow port of said proportional flow control valve.

2. Apparatus in accordance with claim 1 wherein said proportional flow control valve is a proportional flow control poppet valve.

3. Apparatus in accordance with claim 1 further comprising operator actuatable devices for producing input signals, a computer controller for receiving said input signals, for producing an output signal indicative of the need for confluence, and for applying said output signal to said electromagnetically actuated piloting valve to move said electromagnetically actuated piloting valve to its first position when there is a need for confluence.

4. Apparatus in accordance with claim 3 further comprising an electrical switch for switching between a confluence state and a non-confluence state, said electrical switch being connected to said computer controller to provide an input signal thereto indicating the position of said electrical switch.

5. Apparatus in accordance with claim 4 further comprising a device for providing a volume signal as an input to said computer controller for adjusting the maximum flow rate in said second hydraulic supply line when fluid is being passed through said confluence valve.

6. Apparatus in accordance with claim 3 further comprising a check valve positioned in said confluence circuit between said proportional flow control valve and said second hydraulic supply line to permit flow in said confluence circuit only from said first hydraulic supply line to said second hydraulic supply line.

7. Apparatus in accordance with claim 6 further comprising an electromagnetically actuated first bleed off valve connected to said first hydraulic supply line, said first bleed off valve being actuated to a closed position by said computer controller when there is a need for confluence.

8. Apparatus in accordance with claim 7 further comprising a service valve for controlling a special attachment connected to said second hydraulic supply line.

9. Apparatus in accordance with claim 8 further comprising an electromagnetically actuated second bleed off valve connected to said second hydraulic supply line, said second bleed off valve being actuated to a closed position by said computer controller when there is a need for confluence.

10. Apparatus in accordance with claim 9 wherein said proportional flow control valve is a proportional flow control poppet valve.

11. Apparatus in accordance with claim 10 further comprising an electrical switch for switching between a confluence state and a non-confluence state, said electrical switch being connected to said computer controller to provide an input signal thereto indicating the position of said electrical switch.

12. Apparatus in accordance with claim 11 further comprising a device for providing a volume signal as an input to said computer controller for adjusting the maximum flow rate in said second hydraulic supply line when fluid is being passed through said confluence valve.

* * * * *